United States Patent [19]

Gartner

[11] Patent Number: 4,598,513

[45] Date of Patent: Jul. 8, 1986

[54] BUILDING WALL CONSTRUCTION

[75] Inventor: Karl Gartner, Gundelfingen, Fed. Rep. of Germany

[73] Assignee: Yoshida Kogyo K. K., Tokyo, Japan

[21] Appl. No.: 520,712

[22] Filed: Aug. 5, 1983

[30] Foreign Application Priority Data

Aug. 9, 1982 [JP] Japan ..... 57-120890[U]

[51] Int. Cl.[4] ..... E06B 1/04

[52] U.S. Cl. ..... 52/206; 52/235; 52/272; 49/DIG. 1

[58] Field of Search ..... 52/206, 235, 272, 279; 49/504, DIG. 1

[56] References Cited

U.S. PATENT DOCUMENTS

| | | | |
|---|---|---|---|
| 3,579,939 | 5/1971 | Eichman | 52/235 |
| 3,751,868 | 8/1973 | Mascioletti | 52/235 |
| 4,395,862 | 8/1983 | Jager et al. | 49/DIG. 1 |

FOREIGN PATENT DOCUMENTS

| | | | |
|---|---|---|---|
| 1919104 | 7/1973 | Fed. Rep. of Germany | 52/272 |
| 2642167 | 4/1977 | Fed. Rep. of Germany | 52/272 |
| 1249034 | 11/1960 | France | 52/272 |
| 1307857 | 9/1962 | France | 52/235 |
| 582857 | 11/1946 | United Kingdom | 52/779 |

*Primary Examiner*—Carl D. Friedman
*Assistant Examiner*—Michael Safavi
*Attorney, Agent, or Firm*—Hill, Van Santen, Steadman & Simpson

[57] ABSTRACT

A building wall construction installed on a building comprises a plurality of successive window units and at least one corner window unit disposed between two adjacent ones of the window units and having a preformed corner angle identical to that of a corner of the building where the corner window unit is positioned. The corner window unit is joined to the adjacent window units by attachment projections positionally adjustably fitted in recesses, respectively. The corner window unit may be of a salient or re-entrant corner angle.

3 Claims, 8 Drawing Figures

BUILDING WALL CONSTRUCTION

BACKGROUND OF THE INVENTION

1. Field of the Invention

The present invention relates to a building wall construction such as a multiple window or window wall, and more particularly to such a building wall construction including a corner unit.

2. Description of the Prior Art

Some building wall constructions known as multiple windows and window walls include various corners such as angular salient and re-entrant corners of 90° and 135° or round salient and re-entrant corners. For constructing such corners, a mullion is first secured as by an anchor to a corner region of an external building wall, and then vertical frame members are attached to the mullion. Where there is any column at the corner region, it has been troublesome to interconnect the mullion and the vertical frame members and glazed wall portions adjacent to the mullion. It has also been a complex task to install an insulation around the mullion. Accordingly, assembling prior building wall corners at a construction site has been a tedious and time-consuming job.

Another problem with the known building corner constructions is that they should be securely connected to adjacent parts to withstand loads due to thermal expansion and contraction of the adjacent parts such as window frames. The corner arrangements cannot be factory-assembled as they fail to provide a sufficient mechanical strength to bear the imposed loads. The mullions in the prior corners make the latter large in size and unsighly in appearance. The difficulty in assembling the building wall corners is such that a desired degree of airtightness and thermal insulation frequently cannot be achieved, the angles of corners cannot be gained to a nicety, and the corner mullions cannot securely be connected to the adjacent members.

SUMMARY OF THE INVENTION

According to the present invention, a building wall construction includes at least one corner window unit installed in a building opening at a corner and disposed between adjacent window units positioned in the building opening. The corner window unit has a preformed corner angle identical to that of the corner of the building. The corner window unit is positionally adjustably joined to the adjacent window units by attachment projections displaceably fitted in recesses of an adjacent unit. The corner window unit may provide a salient or re-entrant corner angle. The salient corner window unit comprises an outer vertical corner attachment, a pair of side vertical frame members fastened to the corner attachment, a pair of inner vertical frame members joined by thermal insulators to the side vertical frame members, a pair of battens coupled to the vertical frame members, respectively, and a pair of panes of glass held by each of the side vertical frame members and each of the battens in a substantially right-angular configuration. The re-entrant corner window unit is composed of an inner L-shaped vertical frame member, an outer vertical frame member connected by thermal insulators to the inner L-shaped vertical frame member, a pair of battens attached to the inner L-shaped vertical frame member, and a pair of panes of glass supported by the outer vertical frame member and each of the battens in substantially right-angular disposition.

It is an object of the present invention to provide a unitized building wall construction which can be attached to a building with utmost ease at the building site.

Another object of the present invention is to provide a unitized building wall construction having a desired degree of airtightness, thermal insulation and mechanical strength.

Still another object of the present invention is to provide a unitized corner window which can be factory-assembled prior to use and hence can have a correct salient or re-entrant corner angle.

A still further object of the present invention is to provide a corner window unit which can be connected easily to adjacent window units.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Throughout the specification, the terms "inner", "outer", "inwardly", and "outwardly" are used with reference to the geometric center of a building in which a building wall construction is to be incorporated.

Figure 1:
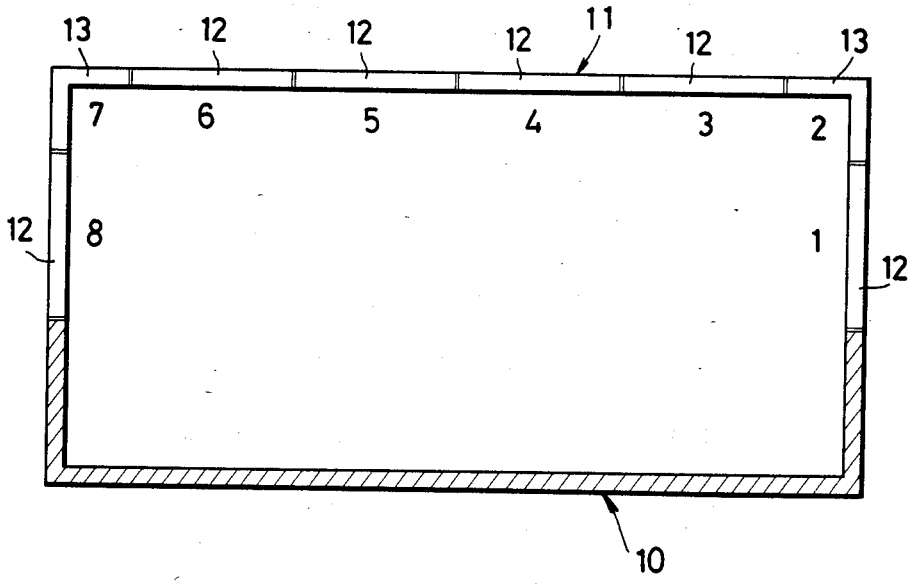
FIG. 1 is a schematic cross-sectional view showing an assembled wall construction as attached to a building.

As shown in FIG. 1, a building 10 has a composite building wall construction 11 including a plurality of window units 12 and corner window units 13 which are interfitted together at their side edges. The window units 12 and corner window units 13 may be assembled together by being installed on the building 10 successively in the order indicated by the numerals 1 through 8.

Figure 2:
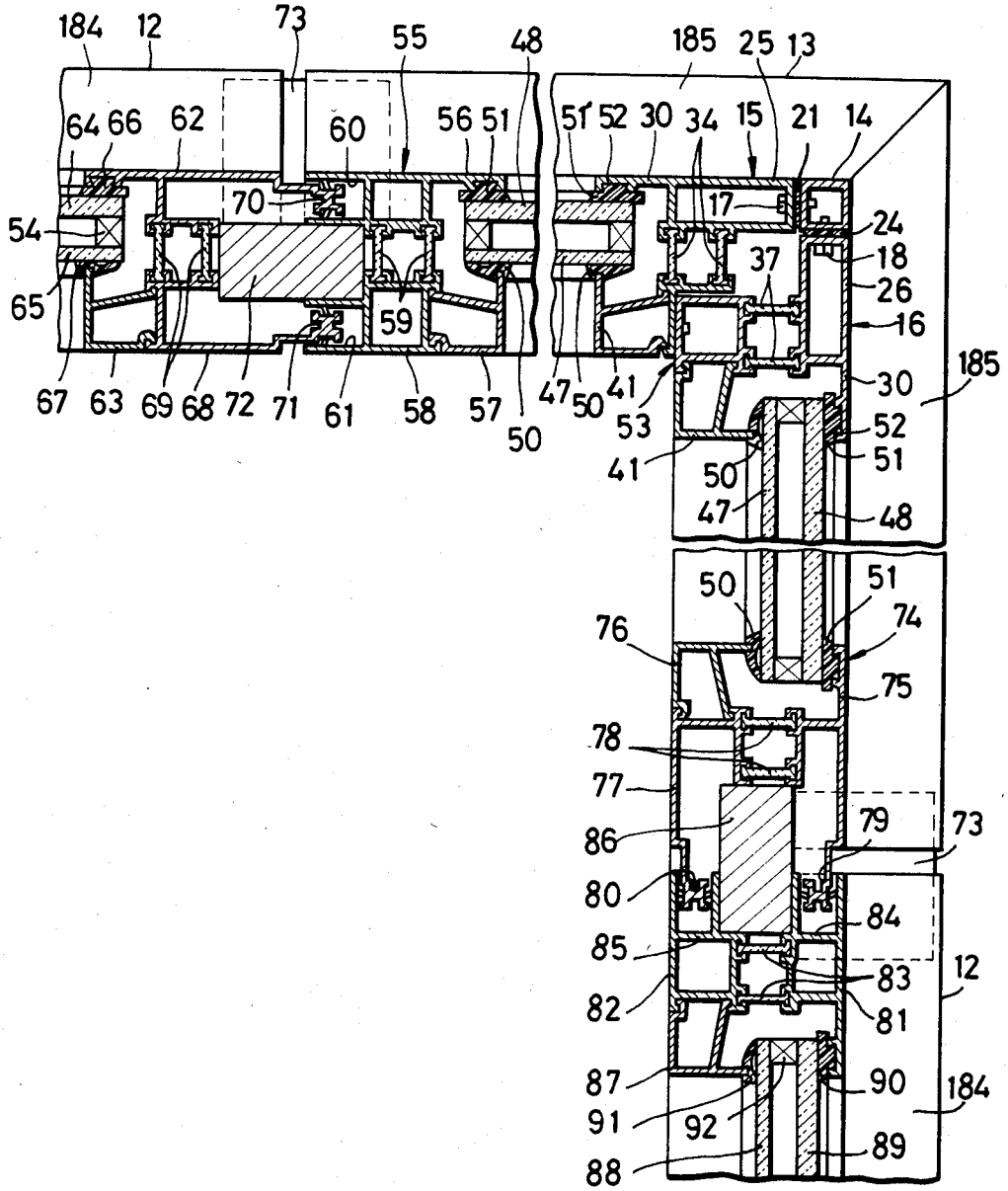
FIG. 2 is a fragmentary horizontal cross-sectional view of a salient corner window unit according to the present invention.
Figure 3:
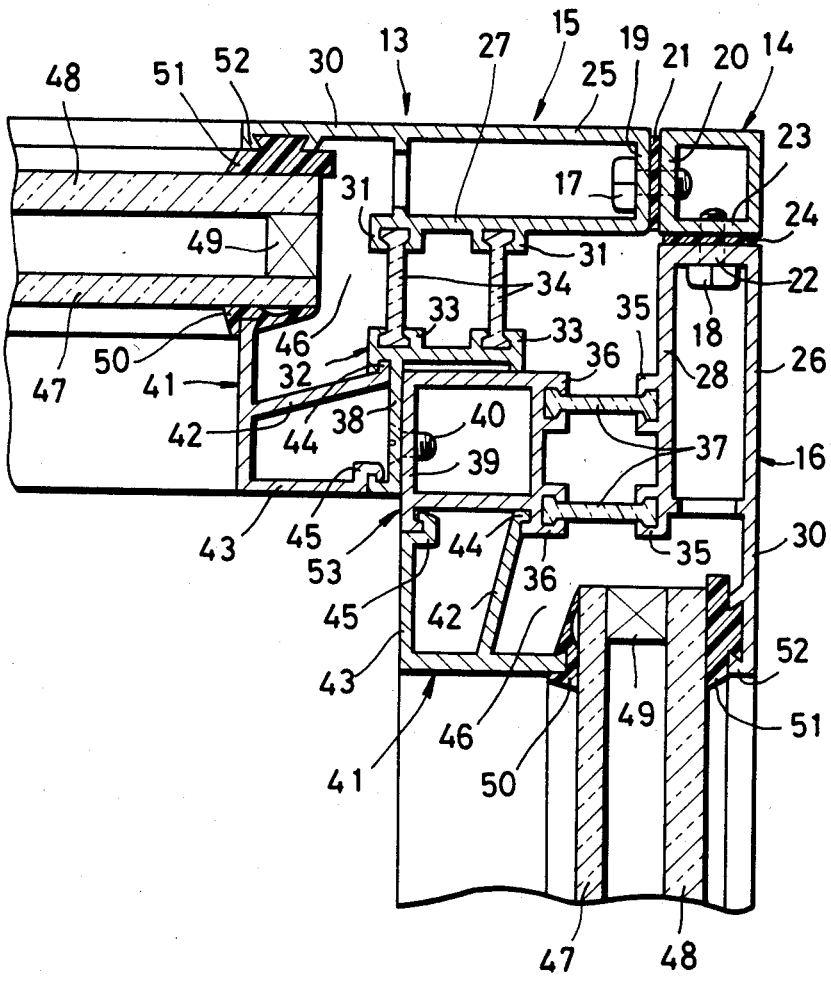
FIGS. 3 and 4 are enlarged fragmentary horizontal cross-sectional views of salient and re-entrant corner window units, respectively, according to the present invention.

As illustrated in FIGS. 2 and 3, each of the corner window units 13 comprises a hollow corner attachment 14 of a square cross section and a pair of hollow side vertical frame members 15, 16 joined by screws 17, 18, respectively, to the corner attachment 14 in a substantially right-angular configuration. The side vertical frame member 15 has an end wall 19 fastened by the screw 17 to a side wall 20 of the corner attachment 14 with a gasket 21 interposed therebetween. Likewise, the side vertical frame member 16 has an end wall 22 fastened by the screw 18 to a side wall 23 of the corner attachment 14 with a gasket 24 interposed therebetween. The side vertical frame member 15 also includes a pair of outer and inner side walls 25, 27, and the side vertical frame member 16 also includes a pair of outer and inner side walls 26, 28. The outer side walls 25, 26 have extensions 30, 30, respectively. The inner side wall 27 of the side vertical frame member 15 has a pair of retainers 31, 31. An L-shaped vertical frame member 32 has a pair of retainers 33, 33. The side vertical frame member 15 is joined to the L-shaped vertical frame member 32 by a pair of thermal insulators 34, 34 having side edges retained by the retainers 31, 33. The inner side wall 28 of the side vertical frame member 16 has a pair of retainers 35, 35. An inner hollow post or vertical frame member 53 of a square cross section is positioned adjacent to the L-shaped vertical frame member 32 in diagonally opposite relation to the corner attachment 14 and has a pair of retainers 36, 36. The side vertical frame member 16 is joined to the inner hollow post 53 by a pair of thermal insulators 37, 37 having side edges retained by the retainers 35, 36. The L-shaped vertical frame member 32 includes a side wall 38 secured by screws 40 (one shown) to a side wall 39 of the inner hollow post 53.

The L-shaped vertical frame member 32 can be formed by cutting off two side walls of a hollow frame member identical to the hollow post 53. Such a hollow frame member serves as a frame unit for use as various vertical and horizontal frame members in the window units 12 and corner window units 13.

A pair of vertical battens 41, 41 is attached to the L-shaped frame member 32 and the inner hollow post 53. Each of the vertical battens 41, 41 is composed of a pair of legs 42, 43 having hooked ends 44, 45, respectively, lockingly engaging the L-shaped frame member 32 and the post 53. The batten 41 attached to the L-shaped frame member 32, one of the thermal insulators 34, and the side vertical frame member 15 jointly define an attachment space or recess 46 receiving therein peripheral edges of a pair of panes of glass 47, 48 spaced by a spacer 49 interposed therebetween. The glass panes 47, 48 are supported in place by a pair of gaskets 50, 51, respectively, retained by the batten 41 and a retainer 52 on the extension 30 of the vertical frame member 15. Likewise, the batten 41 attached to the hollow post 53, one of the thermal insulators 37, and the side vertical frame member 16 jointly define an attachment space or recess 46 receiving therein peripheral edges of another pair of panes of glass 47, 48 spaced by a spacer 49 interposed therebetween. The glass panes 47, 48 are supported in place by a pair of gaskets 50, 51, respectively, retained by the batten 41 and a retainer 52 on the extension 30 of the vertical frame member 16.

As illustrated in FIG. 2, a vertical frame member 55 includes an outer frame member 56 and an inner frame member or batten 57 supporting the glass panes 47, 48 therebetween through the gaskets 50, 51. The vertical frame member 55 also has another inner frame member 58 to which the inner frame member 57 is secured. The outer and inner frame members 56, 58 are interconnected by a pair of thermal insulators 59, and provide a pair of spaces or recesss 60, 61, respectively. The window unit 12 adjacent to the vertical frame member 55 includes an outer frame member 62 and an inner frame member or batten 63 between which a pair of panes of glass 64, 65 is supported through a pair of gaskets 66, 67, the glass panes 64, 65 being spaced by a spacer 54. The window unit 12 also includes another inner frame member 68 coupled to the inner frame member 63 and also to the outer frame member 62 by a pair of thermal insulators 69, 69. The outer and inner frame members 62, 68 have a pair of attachment projections 70, 71 movably fitted respectively in the recesss 60, 61 in the vertical frame member 55. A thermal insulator 72 is disposed between the outer and inner frame members 62, 68 and extends into the vertical frame member 55.

The corner window unit 13 also has another vertical frame member 74 composed of an outer frame member 75 and an inner frame member or batten 76 holding the glass panes 47, 48 through the gaskets 50, 51. The vertical frame member 74 also has another inner frame member 77 joined to the inner frame member 74 and coupled to the outer frame member 75 by a pair of thermal insulators 78, 78. The outer and inner frame members 75, 77 have attachment projections 79, 80. The window unit 12 adjacent to the vertical frame member 74 has an outer frame member 81 and an inner frame member 82 coupled together by a pair of thermal insulators 83, 83 the frame members 81, 82 respectively having a pair of spaces or recesss 84, 85, in which the attachment projections 79, 80 are movably received. A thermal insulator 86 is disposed in the vertical frame member 74 between its outer and inner frame members 75, 77 and has an edge positioned between the recesss 84, 85. The window unit 12 also includes another inner frame member or batten 87 held in locking engagement with the inner frame member 82. The outer and inner frame members 81, 87 support therebetween a pair of panes of glass 88, 89 through a pair of gaskets 90, 91, the glass panes 88, 89 being spaced by a spacer 92.

The corner window unit 13 has a pair of weathering boards or flashings 185 extending outwardly along its lower edges, and each of the window units 12 adjacent to the corner window unit 13 also has a weathering board or flashing 184 extending outwardly along its lower edge. Between the corner window unit 13 and each of the adjacent window units 12, there is a connecting plate 73 extending below the weathering boards 185, 184 and joined at one end to either the corner window unit 13 or the window unit 12.

Figure 4:
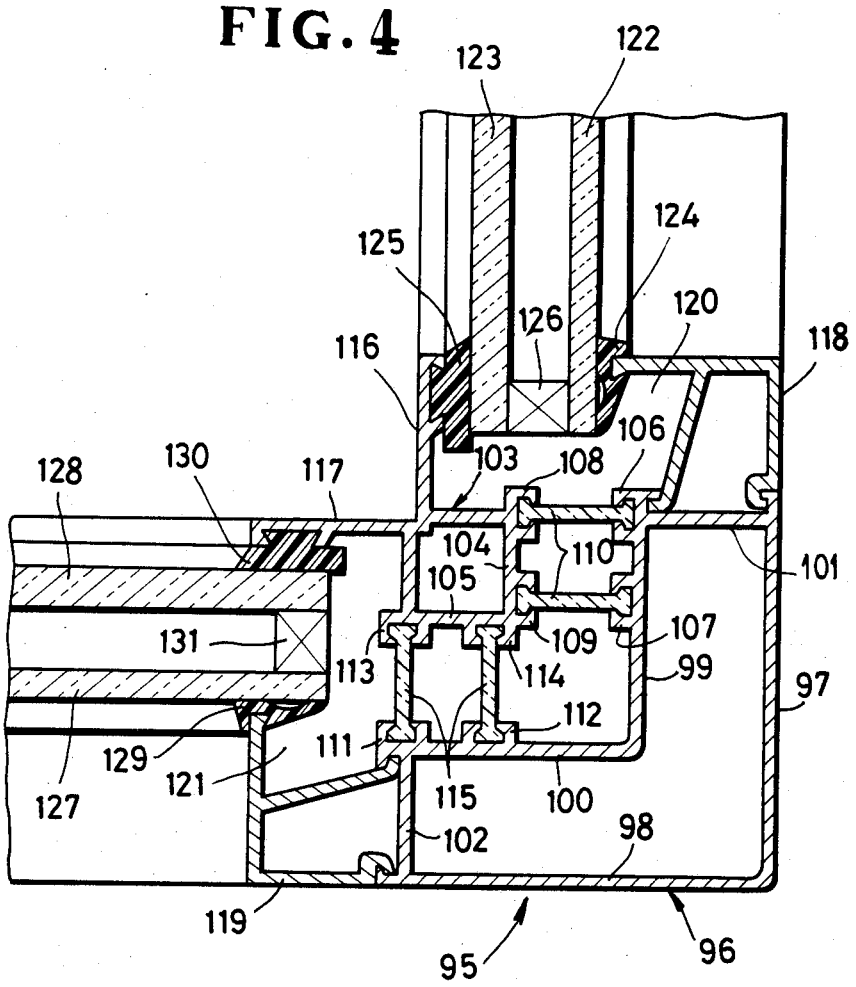

FIG. 4 shows a corner window unit 95 according to another embodiment of the present invention. The corner window unit 95 being constructed for use at a reentrant corner. The corner window unit 95 includes an L-shaped inner hollow vertical frame member 96 composed of a pair of inner side walls 97, 98 and a pair of outer side walls 99, 100 interconnected to the inner side walls 97, 98 by a pair of end walls 101, 102, respectively. An outer hollow vertical frame member 103 of a square cross section is disposed diagonally opposite to the outer vertical frame member 96 and includes a pair of inner side walls 104, 105. The outer side wall 99 has a pair of retainers 106, 107, and similarly the inner side wall 104 has a pair of retainers 108, 109. The outer side wall 99 and the inner side wall 104 are joined by a pair of thermal insulators 110, 110. Likewise, the outer side wall 100 has a pair of retainers 111, 112, and similarly the inner side wall 105 has a pair of retainers 113, 114. The outer side wall 100 and the inner side wall 105 are joined by a pair of thermal insulators 115, 115.

The outer vertical frame member 103 has a pair of flanges 116, 117. The corner window unit 95 also includes a batten or inner vertical frame member 118 mounted on the end wall 101 of the inner vertical frame member 96. The batten 118 and the flange 116 jointly provide a space or recess 120 receiving therein edges of a pair of glass panes 122, 123 supported by the inner vertical frame member 118 and the flange 116 a pair of gaskets 124, 125. The glass panes 122, 123 are spaced by a spacer 126 interposed therebetween. Likewise, a batten or inner vertical frame member 119 is mounted on the end wall 102 of the inner vertical frame member 96. The batten 119 and the flange 117 jointly provide a space or recess 121 receiving therein edges of a pair of glass panes 127, 128 supported by the inner vertical frame member 119 and the flange 117 a pair of gaskets 129, 130. The glass panes 127, 128 are spaced by a spacer 131 interposed therebetween.

Opposite edges of the glass panes 122, 123 and 127, 128 are supported by vertical frame members (not shown) which are identical in construction to the vertical frame members 55, 74 illustrated in FIG. 2.

Figure 5:
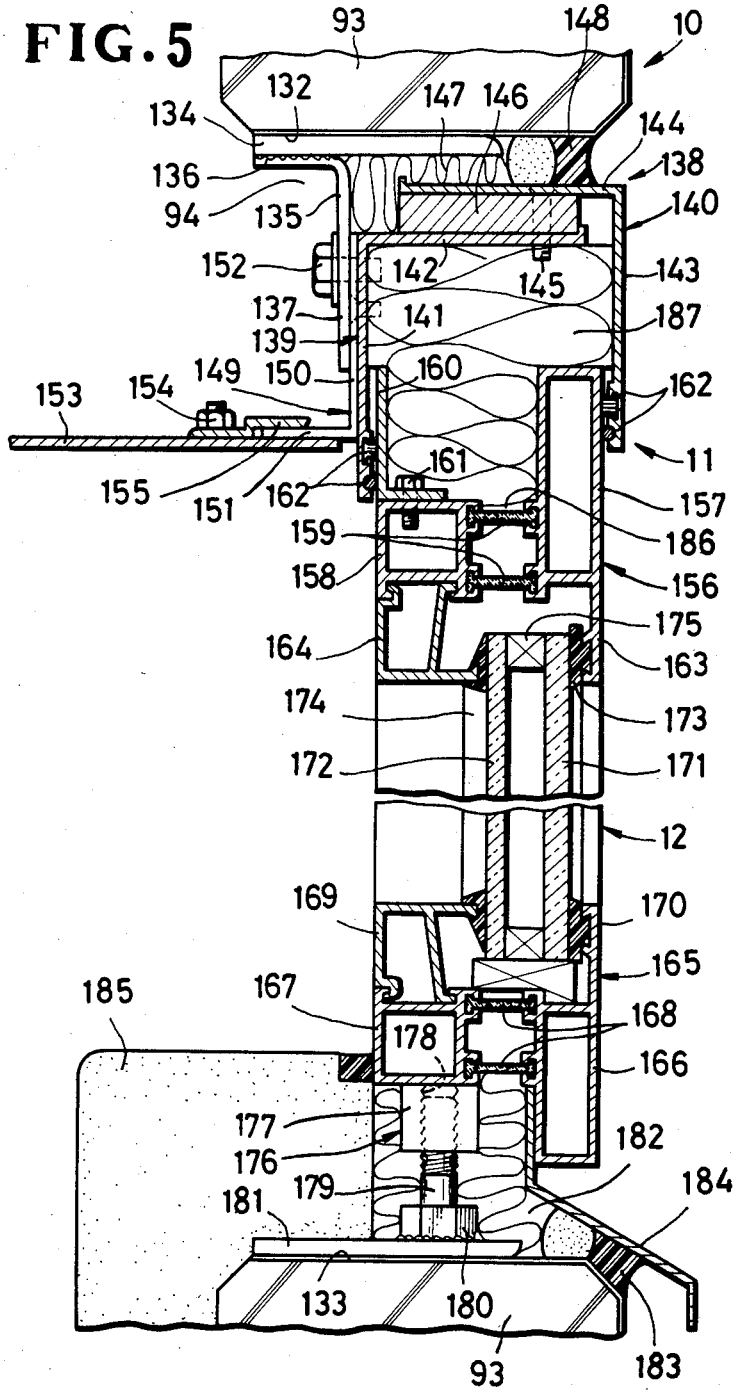
FIG. 5 is a vertical cross-sectional view of a window unit installed in place in a building opening.

FIG. 5 shows one of the window units 12 in vertical cross section as attached to the building 10. The building 10 has a building wall 93 having an opening 94 defined by upper and lower edges 132, 133. An attachment plate 134 is welded or otherwise fixed to the upper edge 132, and an L-shaped angle member 135 has an inward flange 136 welded or otherwise fixed to the attachment plate 134. The angle member 135 also has a vertical flange 137 extending downwardly into the opening 94. An upper frame 138 includes an inner L-shaped frame member 139 and an outer L-shaped frame member 140. The inner frame member 139 is composed of a vertical side wall 141 and a horizontal side wall 142 extending outwardly. The outer frame member 140 is composed of a vertical side wall 143 and a horizontal side wall 144 extending inwardly. The horizontal side walls 142, 144 are interconnected by fasteners 145 with a thermal insulator 146 interposed therebetween. A thermal insulator 147 such as of glass wool or rock wool is inserted between the attachment plate 134 and the horizontal side walls 142, 144, and a caulking material 148 is placed between the upper edge 132 and the horizontal side wall 144.

An L-shaped bracket 149 has a vertical member 150 inserted between the vertical flange 137 and the vertical side wall 141 and fastened thereto by screws 152. The bracket 149 includes an inner horizontal member 151 attached to a ceiling panel 153 by a retainer 155 secured thereto by bolts 154.

The window unit 12 includes an upper horizontal frame 156 composed of an outer hollow frame member 157 and an inner hollow frame member 158 interconnected by a pair of thermal insulators 159. An L-shaped bracket 160 is fastened by screws 161 to the inner hollow frame member 158. The outer hollow frame member 157 and the bracket 160 are partly received in the upper frame 138 with seal members 162 supported on the vertical side walls 141, 143 and held against the frame member 157 and the bracket 160.

The outer frame member 157 includes a downward projection 163. A batten or inner horizontal frame member 164 is disposed below and secured to the inner frame member 158. The downward projection 163 and the batten 164 jointly support therebetween the upper edges of a pair of panes of glass 171, 172 through a pair of gaskets 173, 174, the glass panes 171, 172 being spaced by a spacer 175.

The window unit 12 also includes a lower horizontal frame 165 including an outer hollow frame member 166 and an inner hollow frame member 167 interconnected by a pair of thermal insulators 168. A batten or inner horizontal frame member 169 is located upwardly of and fixed to the inner frame member 167. The outer frame member 166 includes an upward projection 170. The batten 169 and the upward projection 170 jointly hold therebetween the lower edges of the glass panes 171, 172.

A plurality of adjustable anchors or attachments 176 (one shown in FIG. 5) are positioned below the lower horizontal frame 165. Each of the adjustable attachments 176 is composed of an attachment block 177 secured to the inner frame member 167 and having a threaded hole 178 and a bolt 179 threaded in the theaded hole 178 and having a bolt head 180 welded or otherwise joined respectively to an attachment plate 181 mounted on the upper edge 133 of the building wall 93. The weathering board 184 is secured to the outer frame member 166 and extends obliquely downwardly. A thermal insulator 182 such as of glass wool or rock wool is placed between the lower horizontal frame 165 and the upper edge 133, and a caulking material 183 is put between the weathering board 184 and the building wall 93.

An interior siding 185 is applied to an inner surface of the building wall 93 below the upper edge 133 and extends thereabove to close the space between the lower horizontal frame 165 and the upper edge 133.

The upper frame 138 and the upper horizontal frame 156 of the window unit 12 jointly provide a space 186 in which a thermal insulator 187 such as of glass wool or rock wool is inserted.

The manner in which the window unit 12 is installed in the building opening 94 will now be described. The thermal insulator 187 is first put into the space 186 in the upper frame 138, and the window unit 12 is placed into the opening 94 with the upper horizontal frame 156 introduced into the upper frame 138. The adjustable attachments 176 are placed on the attachment plate 181, respectively. The bolts 179 of the adjustable attachments 176 are now turned to adjust the vertical position of the window unit 12 into horizontal alignment with the adjacent window units 12 or corner window unit 13. The window unit 12 can be shifted inwardly or outwardly on the attachment plate 181 until it is positioned in a desired vertical plane. After the adjustable attachments 176 have been adjusted, the heads 180 of the bolts 179 are welded or otherwise secured to the attachment plate 181. Then, the thermal insulator 182 and the caulking material 183 are placed in position, and the interior siding 185 is applied.

Figure 6:
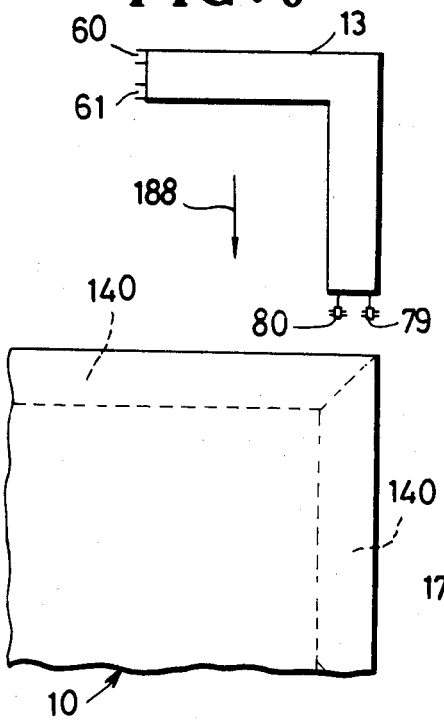
FIG. 6 is a schematic horizontal plan view showing the manner in which a corner window unit is installed in place.
Figure 7:
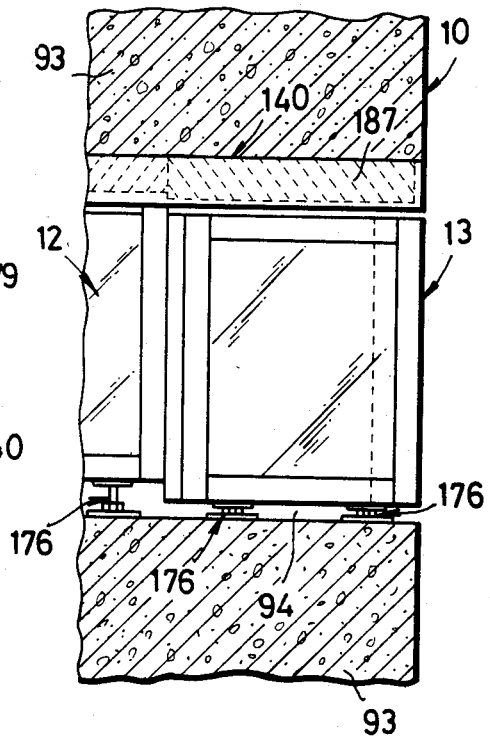
FIGS. 7 and 8 are fragmentary side elevational views showing the way in which the position of a corner window unit is vertically adjusted.
Figure 8:
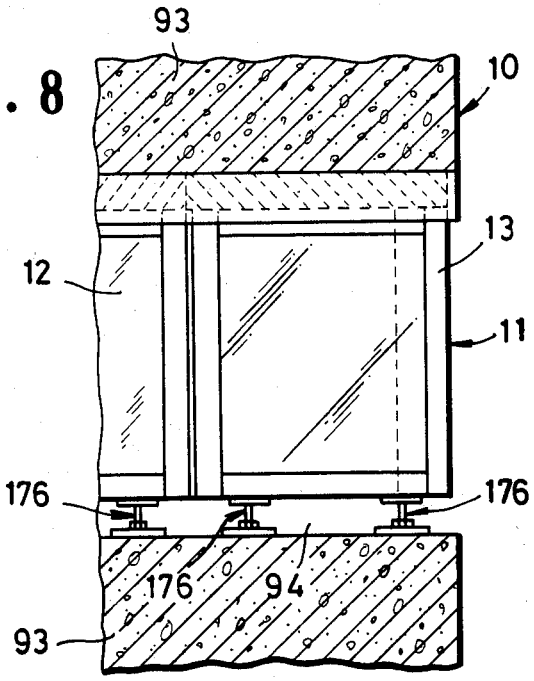

Although not shown, the corner window unit 13 has a vertical cross section which is substantially the same as that of the window unit 12, and can be installed in position in substantially the same manner as described above. As illustrated in FIG. 6, the upper frames 140 have abutting ends metered at an angle of 45°. With the thermal insulator 187 placed in the upper frames 140, the corner window frame 13 is brought into the building opening 94 in the direction of the arrow 188. As installed, the attachment projections 79, 80 of the corner window unit 13 are movably disposed in the recesses 84, 85 in one of the adjacent window units 12 and the attachment projections 70, 71 of the other adjacent window unit 12 are moved into the recesses 60, 61 in the corner window unit 13. Therefore, the corner window unit 13 is positionally adjustable with respect to the adjacent window units 12, 12.

With the foregoing arrangement, the building wall contruction is composed of unitized window units and corner window units which can be put together with utmost ease at construction sites. The window units and corner window units are factory-assembled to a desired degree of dimensional accuracy so that they can be interconnected easily and smoothly. The prefabricated corner window units provide precise corner angles and building wall corners of neat appearance and increased mechanical strength. The various thermal insulators incorporated in the window units and corner window units give a desired degree of thermal insulation.

The hollow vertical frame member or post 53 and the hollow horizontal frame members 158, 167 are of the same cross section and thus can be prepared by severing hollow structural members of identical cross section.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A building wall construction for attachment to a building having an opening and a corner, comprising:

(a) a plurality of successively joined window units adapted to be mounted in the opening; and (b) a corner window unit disposed between two adjacent ones of said window units and adapted to be mounted in the opening at the corner, said corner window unit having a preformed corner angle identical to that of the corner of the building, said corner window unit being joined to said two window units through adjustable interfitting engagement, said corner window unit having attachment projections on a side edge thereof and recesses in an opposite side edge, one of said two adjacent window units having recesses in which said attachment projections of the corner window unit are displaceably fitted, respectively, and the other of said two window units having attachment projections displaceably fitted in said recesses, respectively, in said corner window unit.

2. A building wall construction for attachment to a building having an opening and a corner, comprising:

(a) a plurality of successively joined window units adapted to be mounted in the opening; and (b) a corner window unit disposed between two adjacent ones of said window units and adapted to be mounted in the opening at the corner, said corner window unit having a preformed corner angle identical to that of the corner of the building, said corner window unit comprising a vertical corner attachment, a pair of side vertical frame members connected to said corner attachment in substantially right-angular configuration, a pair of vertical frame members positioned in diagonally opposite relationship to said vertical corner attachment, a plurality of thermal insulators interconnecting said side vertical frame members and said vertical frame members, a pair of battens attached to said vertical frame members, and two pair of panes of glass, each pair being respectively supported by said side vertical members and said battens in substantially right-angular disposition.

3. A building wall construction according to claim 2, each of said vertical corner attachment, said side vertical frame members, and one of said vertical frame members being of a hollow configuration.

* * * * *